US010661975B2

(12) United States Patent
Slooff et al.

(10) Patent No.: US 10,661,975 B2
(45) Date of Patent: May 26, 2020

(54) RESEALABLE CONTAINER INCLUDING INSERT

(71) Applicant: Philip Morris Products S.A., Neuchâtel (CH)

(72) Inventors: Arjen Hamilcar Slooff, Oosterbeek (CH); Lucas Chatelain, Lausanne (CH); Luiz Andre Rodrigues, Neuchâtel (CH); Ross Lange, Neuchâtel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

(21) Appl. No.: 15/770,316

(22) PCT Filed: Sep. 21, 2016

(86) PCT No.: PCT/IB2016/055630
§ 371 (c)(1),
(2) Date: Apr. 23, 2018

(87) PCT Pub. No.: WO2017/072606
PCT Pub. Date: May 4, 2017

(65) Prior Publication Data

US 2018/0334317 A1 Nov. 22, 2018

(30) Foreign Application Priority Data

Oct. 26, 2015 (EP) ..... 15191534

(51) Int. Cl.
*B65D 85/10* (2006.01)
*B65D 5/42* (2006.01)

(52) U.S. Cl.
CPC ..... *B65D 85/1081* (2013.01); *B65D 5/4233* (2013.01); *B65D 85/1045* (2013.01)

(58) Field of Classification Search
CPC ..... B65D 85/1081; B65D 85/1045; B65D 85/10; B65D 85/1027; B65D 5/4233; A24F 15/00
(Continued)

(56) References Cited

U.S. PATENT DOCUMENTS 5,363,955 A * 11/1994 Fleenor ..... B65D 5/422 206/268
5,533,613 A * 7/1996 Minarelli ..... B65D 85/1045 206/268
(Continued)

FOREIGN PATENT DOCUMENTS

CH 690 005 A5 3/2000
CN 102245481 A 11/2011
(Continued)

OTHER PUBLICATIONS

Extended European Search Report, issued by the European Patent Office, for EP Application No. 15191534.5, dated Feb. 18, 2016; 7 pgs.
(Continued)

*Primary Examiner* — J. Gregory Pickett
*Assistant Examiner* — Tia Cox
(74) *Attorney, Agent, or Firm* — Mueting, Raasch & Gebhardt, P.A.

(57) ABSTRACT

Containers that comprise a housing that comprises a box and a lid that is hingedly attached to the box. The lid comprises a front wall that has an inner surface, an outer surface and a bottom edge. The container also comprises an inner package disposed at least partially within the housing and at least partially defining an interior volume for housing consumer goods. The container also comprises a resealable label configured to open and close the inner package when the lid of the housing is opened and closed, wherein the resealable
(Continued)

lable is positioned adjacent the inner surface of the front wall of the lid. The container also comprises an insert comprising a line of weakness and a communication portion, wherein the insert is coupled to the resealable label to maintain connection of the insert with the container until the line of weakness is broken.

12 Claims, 5 Drawing Sheets

(58) Field of Classification Search
USPC ..... 206/459.5, 242–276; 220/528
See application file for complete search history.

(56) References Cited

U.S. PATENT DOCUMENTS 6,478,149 B1 * 11/2002 Parker ..... B60B 37/10 206/273
6,513,651 B1 2/2003 Focke et al.
6,736,262 B2 5/2004 Focke et al.
6,742,652 B1 * 6/2004 Focke ..... B65D 85/1045 206/268
7,845,491 B2 * 12/2010 Polloni ..... B65D 5/422 206/268
7,870,953 B2 * 1/2011 Tanbo ..... B65D 85/1081 206/232
8,141,701 B2 * 3/2012 Hodges ..... A24C 5/608 206/268
2004/0026271 A1 * 2/2004 Conti ..... B65D 85/1081 206/259
2011/0147443 A1 * 6/2011 Igo ..... B65D 85/1045 229/117.31
2011/0303567 A1 12/2011 Bray
2012/0006823 A1 * 1/2012 Bertuzzi ..... B65D 75/5838 220/270
2014/0374290 A1 12/2014 Seyfferth De Oliveira
2015/0021219 A1 * 1/2015 Seyfferth De Oliveira ..... B65D 85/1045 206/268
2015/0027916 A1 * 1/2015 Buse ..... B65B 19/025 206/268
2015/0321831 A1 * 11/2015 Ghini ..... B65D 85/1045 206/268

FOREIGN PATENT DOCUMENTS

CN 104010943 A 8/2014
DE 198 41 942 A1 3/2000
DE 102 08 026 A1 9/2003
WO WO 94/29193 A1 12/1994
WO WO-2013120913 A1 * 8/2013 ..... B65D 85/1045
WO WO 2014/188358 A1 11/2014
WO WO 2015/045070 A1 4/2015
WO WO 2015/059655 A1 4/2015
WO WO 2016/087818 A1 6/2016

OTHER PUBLICATIONS

International Search Report and Written Opinion, issued by the European Patent Office, for PCT/IB2016/055630, dated Nov. 30, 2016; 11 pgs.
International Preliminary Report on Patentability, issued by the European Patent Office, for PCT/IB2016/055630, dated Oct. 17, 2017; 13 pgs.
Chinese Office Action for CN Application No. 201680059129.7; dated May 27, 2019 by the Chinese National Intellectual Property Administration; 15 pages, including English Translation.

* cited by examiner

RESEALABLE CONTAINER INCLUDING INSERT

This application is the § 371 U.S. National Stage of International Application No. PCT/IB32016/055630, filed 21 Sep. 2016, which claims the benefit of European Patent Application No. 15191534.5, filed 26 Oct. 2015, the disclosures of which are incorporated by reference herein in their entireties.

The present invention relates to a resealable container for consumer goods that includes an accessible insert. The container finds particular application as a container for elongate smoking articles such as cigarettes.

It is common in the industry to use inserts as a means of communication.

WO 94/29193 describes a hinged lid pack with a pop out coupon. The coupon is an extension of the lid itself and is made of the same material as the lid. However, with current resealable containers, and more specifically automatically resealable containers use of an insert is not possible because there is no space available to access additional components, like an insert.

WO 2016/087818 describes a hinged lid pack that includes an insert. The insert is located inside the bundle so that it lies between the smoking articles and a front wall of the barrier layer. The insert has an upper end portion that protrudes above a lower front wall edge of the opening One object of the invention is to provide a container that both affords automatic opening and resealing of an inside sealed package upon opening the outer lid and access to an insert.

In one aspect of the present invention, a container is described. The container comprises a housing that comprises a box and a lid that is hingedly attached to the box. The lid comprises a front wall that has an inner surface, an outer surface and a bottom edge. The container also comprises an inner package disposed at least partially within the housing and at least partially defining an interior volume for housing consumer goods. The container also comprises a label configured to open and close the inner package when the lid of the housing is opened and closed. The label is positioned adjacent the inner surface of the front wall of the lid. The container also comprises an insert. The insert comprises a line of weakness and a communication portion. The insert is coupled to the label and connection of the entirety of the insert to the container is maintained until the line of weakness is broken. In some embodiments, coupled can include an insert that is coextensive with the label and in some embodiments it can include an insert that is affixed to the label.

Various aspects of the present invention may provide one or more advantages relative to currently—available or previously—described containers. For example, the present containers combine the feature of being automatically resealable with the use of inserts, which up until the present invention were unable to be combined. Furthermore, the present containers afford the combination of these two features but do not sacrifice proper functionality of the automatic closure of the inner feature. Also, upon opening the container, the insert is forced away from the container, this may make the insert more effective in communicating. The insert can be a different material than the housing of the container, which may allow more options for communication.

The present invention is applicable to any suitable container for consumer goods such as for example elongate smoking articles. It is known to package consumer goods such as, for example, elongate smoking articles in containers formed from folded laminar blanks. For example, elongate smoking articles, such as cigarettes and cigars, are commonly sold in hinge lid packs having a box for housing the smoking articles and a lid connected to the box about a hinge line extending across the back wall of the container.

The container may take any suitable form for housing consumer goods. For example, as already mentioned, the container may comprise a housing that can be described as a hinge-lid container having one or more hinged lids connected to a box housing the consumer goods. In one or more embodiments, the container may be a slide and shell container having an inner slide for housing the consumer goods mounted within an outer shell. Where the container is a slide and shell container, the outer shell or the inner slide may include one or more hinge lids. The container may be formed from any suitable materials including, but not limited to, cardboard, paperboard, plastic, metal, other materials, or combinations thereof. The cardboard may have a weight of between about 100 grams per square meter and about 350 grams per square meter.

Containers described herein will generally have the same or a similar shape as the housing. As such housings according to the invention may be in the shape of a rectangular parallelepiped, with right-angled longitudinal and right-angled transverse edges. Alternatively, the housing may comprise one or more rounded longitudinal edges, rounded transverse edges, bevelled longitudinal edges, or bevelled transverse edges, other types of edges, or combinations thereof. For example, the housing according to the invention may comprise, without limitation, one or more of the following features:

- one or two longitudinal rounded or bevelled edges on at least one of the front wall and the back wall;
- one or two transverse rounded or bevelled edges on at least one of the front wall and the back wall;
- one longitudinal rounded edge and one longitudinal bevelled edge on the front wall, or one transverse rounded edge and one transverse bevelled edge on the back wall;
- one longitudinal rounded edge and one longitudinal bevelled edge on the front wall, and one transverse rounded edge and one transverse bevelled edge on the back wall;
- one or two transverse rounded or bevelled edges on the front wall and one or two longitudinal rounded or bevelled edges on the front wall; and
- two longitudinal rounded or bevelled edges on a first side wall or two transverse rounded or bevelled edges on the second side wall.

Where the housing comprises one or more rounded edges, preferably the blanks forming the housing comprise three, four, five, six, or seven scoring lines or creasing lines to form each rounded edge in the assembled container. The scoring lines or creasing lines may be either on the inside of the housing or on the outside of the housing. Preferably, the scoring lines or creasing lines are spaced from each other by between about 0.3 millimetres (mm) and 4 mm.

Preferably, the spacing of the creasing lines or scoring lines is a function of the thickness of the laminar blank. Preferably, the spacing between the creasing lines or scoring lines is between about 0.5 and about 4 times larger than the thickness of the laminar blank.

Where the housing comprises one or more bevelled edges, preferably the bevelled edge has a width of between about 1 mm and about 10 mm, preferably between about 2 mm and about 6 mm. In one or more embodiments, the housing may comprise a double bevel formed by three parallel creasing or scoring lines that are spaced such that two distinct bevels are formed on the edge of the container. Where the housing comprises a bevelled edge, the bevel may be formed by two parallel creasing lines or scoring lines in the laminar blank from which the container is formed. The creasing lines or scoring lines may be arranged symmetrically to the edge between a first wall and a second wall. Alternatively, the creasing lines or scoring lines may be arranged asymmetrically to the edge between the first wall and the second wall, such that the bevel reaches further into the first wall of the container than into the second wall of the housing.

Alternatively, the housing may have a non-rectangular transverse cross section, for example, polygonal such as triangular or hexagonal, or oval, semi-oval, circular or semi-circular.

Containers according to the invention find particular application as packs for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Through an appropriate choice of the dimensions thereof, containers or housings according to the invention may be designed to hold different total numbers of smoking articles, or different arrangements of smoking articles. For example, through an appropriate choice of the dimensions thereof, containers or housings according to the invention may be designed to hold a total of between ten and thirty smoking articles.

As well as housing a bundle of smoking articles, the container may further comprise other consumer goods, for example, matches, lighters, extinguishing means, breath-fresheners, or electronics. The other consumer goods may be attached to the outside of the container, contained within the container along with the smoking articles, in a separate compartment of the container, or any combination thereof.

Disclosed containers comprise a housing. The housing has an inner surface and an outer surface. The housing also has a rear wall, a front wall and two side walls. The housing comprises a lid and a box.

The lid of the housing is hingedly attached to the box and is adapted to be manipulated between an open position and a closed position. In the open position, the consumer can access the consumer goods disposed within the housing. The lid is hingedly attached to the box along a hinge line that extends across the rear wall or the upper edge of the rear wall of the housing. A hinge line may be, for example, a fold line or a score line in the panel forming the back wall of the housing. The lid and box are further defined by an opening line. The opening line refers to the delineation between the lid and the box.

Preferably, the box comprises a box front wall, a box left side wall, a box right side wall, a box back wall, and a box bottom wall. The box has an inner surface and an outer surface. The front wall of the box has an upper edge, which when closed meets the bottom edge of the lid.

Preferably, the lid comprises a lid front wall, a lid left side wall, a lid right side wall, a lid back wall, and a lid top wall. The lid has an inner surface and an outer surface. The front wall of the lid also has a bottom edge.

The container also comprises an inner package. The inner package is disposed within the housing of the container. The inner package can be configured to house consumer goods. Illustrative consumer goods can include smoking articles such as elongate smoking articles. Specific illustrative elongate smoking articles can include for example cigarettes, cigars or cigarillos. In other embodiments, the consumer goods may be aerosol-generating articles such as articles that heat but not burn tobacco.

The inner package can be made of any suitable materials, for example, polymeric materials, metal foils, other materials, or combinations thereof. The inner package preferably comprises polymeric materials such as polyethylene films, polyolefin films, poly lactic acid (PLA) films, or some combination thereof. Preferably, the inner package can comprise a first layer and a second layer that are attached, at least at their peripheries to form a package with an interior volume.

The inner package comprises an access opening that affords access to the consumer goods housed inside when the inner package is opened. Preferably, the first layer of a multilayer inner package comprises a flap. The flap of the inner package covers the access opening when the container and the flap are in a closed position. The access opening is at least partially uncovered when the container and the flap are in the open position. The access opening can be cut during manufacturing, for example. Preferably, the flap forms an S—curve, a curve with at least two turning points, when the flap is open. The flap can be attached to the inner surface of the lid with a label comprising one or more adhesive portions. This label can be referred to as a resealable label.

The resealable label can be configured to attach the flap to the inner surface of the lid as well as reseal the inner package. In such an embodiment, when opening the lid and the inner package, a portion of the second layer attached to the flap, the sealing region, are separated from each other along first and second cut lines respectively to reveal the access opening. The resealable label can be attached to the lid using any suitable techniques, for example, mechanical attachment, adhesive, thermal, or ultrasonic bonding. Preferably, the resealable label can be attached to the lid using an adhesive, more preferably a permanent adhesive. The resealable label can be configured to be re-attached to the second layer when the flap and the lid of the container are in the closed position.

The resealable label allows for repeated opening and closing of the inner package to access the consumer goods individually. The resealable label preferably provides sufficient adhesion for the flap to be re-attached to the second layer as the sealing region at least as many times as there are consumer goods within the inner package. The resealable label preferably enables a consumer to open and reseal the inner package until the package is empty. In some embodiments, the inner package can be opened the first time by using a force of not greater than about 15 Newtons, or more preferably not greater than about 12 Newtons.

The resealable label has an inner surface and an outer surface. The outer surface of the resealable label can be configured to permanently attach the label and in some embodiments, the flap of the inner package to the inner surface of the front wall of the lid.

The inner surface of the resealable label can comprise at least a sealing area and a non-sealing area. The sealing area can be such that movement of the lid between open and closed positions simultaneously moves the flap and the access opening of the inner package between opened and closed positions. In the closed position, the flap and label cover the access opening of the inner package and is resealably attached to the inner package by the resealable adhesive. In the open position, the flap and label are at least partially detached from the inner package and the access opening of the inner package is at least partially uncovered or opened. The sealing area of the label can utilize an adhesive for example, preferably a pressure sensitive adhesive. The nonsealing area of the inner surface of the label is preferably positioned at the lower end of the label, which will be towards the bottom edge of the lid. It should be noted that the non-sealing area can include adhesive but such adhesive does not contribute to sealing the inner package. The non-sealing area can allow for the sealing area to be more easily opened.

The container also comprises an insert. The insert comprises a communication portion and a line of weakness. The communication portion of the insert can be used for communication. The communication portion can comprise or be made of any suitable material or materials. For example, the communication portion can comprise cardboard, paperboard, paper, plastic, metal, or combinations thereof. Preferably, the communication portion is made of a material different than that of the box. The insert can be printed thereon for example using any known printing techniques. The communication portion can be folded in order to increase the available communication space. The communication portion can be folded longitudinally or transversally or both longitudinally and transversally. Preferably, at least one dimension of the communication portion (whether in total or once folded), for example, the height of the communication portion, can be less than the height of the front wall of the box. Preferably, the length of the communication portion is between the length of the longest longitudinal length of the front wall and the length of the front wall in the area of the access region. Such configurations afford the use of the maximum length of the communication portion. Preferably, the other dimension of the communication portion (whether in total or once folded), for example the width of the communication portion, can be less than the width of the front of the box. Because of the ability to fold the communication portion, once, twice, or more often the overall surface area of the communication portion can be larger than the front wall of the box.

The insert also comprises a line of weakness. Lines of weakness can be formed using any available methods. Preferably, lines of weakness can be formed by mechanical cutting; by use of a laser; by degrading a portion of the box using ultraviolet (UV) energy, infrared (IR) energy, Gamma energy, X-ray energy, chemical treatment, thermal treatment, galvanic treatment, other treatments, or any combination thereof. Lines of weakness can be formed before the label is put into a container (if the insert is coextensive with the label), after the label is put into a container (if the insert is coextensive with the label), before the label is affixed to an insert, or after a label is affixed to the insert.

A line of weakness need not be continuous, and can for example include an offset portion. A line of weakness can be described by its thickness. The thickness can describe the thickness of the cut in the insert or the depth to which the degradation extends in the insert, for example. Some inserts can include a line of weakness or a portion of a line of weakness that extends through the entire thickness of the insert. A line of weakness can also have different depths at different points. A line of weakness can also be described by the force necessary to break the insert at the line of weakness. Preferably, a line of weakness, whether the line of weakness is a cut, slit or perforation in the insert or degradation of a portion of the insert, may require a force not greater than about 12 Newtons to break, preferably, the force is smaller than 6 Newtons to break, more preferably, the force is smaller than 3 Newtons to break.

The insert is coupled to the resealable label. This coupling can include the insert being affixed to the label or being co-extensive with the label. In embodiments where the insert is affixed to the label, the label can be affixed just above the line of weakness with the communication portion being below the line of weakness. Preferably, therefore, there is an additional portion of the insert, an attachment portion, and it is at the attachment portion of the insert that it is affixed or attached to the label. In such embodiments, the line of weakness separates the attachment portion from the communication portion.

The insert can be affixed or attached between the label and the lid or the label can be affixed between the insert and the lid. In the latter configuration, the insert does not extend far enough along the label to interfere with the ability of the label to seal and reseal the inner package. In either configuration, the items can be affixed using any suitable techniques, for example, mechanical attachment, adhesive, thermal, or ultrasonic bonding. Preferably, the label-to-insert-to-lid structure or insert-to-label-to-lid structure can be attached using an adhesive, more preferably a permanent adhesive.

The insert can also be coextensive or coincident with the label. In such embodiments, the label is the portion that attaches the flap of the inner package to the lid of the housing. The label functions to reseal the inner package when the lid is closed and the insert is the portion that is adjacent the box, when the container is closed. The insert portion then comprises the line of weakness and the communication portion.

The label portion of the coextensive label-insert combination can be configured so that it extends to the point on the lid where the adhesive is placed on the front inside panel of the lid, binding the inner package to the housing. Alternatively, the label could be extended to the bottom limit of the lid. In this case, the glue binding the inner package to the inner surface of the lid is not applied to the front inside panel of the lid. In some embodiments, a label that is coextensive with an insert can be longer than a typically or previously utilized label.

The line of weakness in such configurations can be positioned at the end of the glued portion where the label is folded and glued to the inner surface of the front wall of the lid. The line of weakness does not receive any glue so that the communication portion can easily be removed from the remainder of the insert. In some embodiments, the line of weakness is positioned so that once the communication portion is removed, no excess portion of the label hangs beyond the bottom edge of the lid. In some embodiments, the line of weakness is positioned so that once the container is assembled; the line of weakness is positioned between the area of adhesive on the resealable label (the sealing area) and the bottom edge of the lid.

In embodiments where the label and insert are coextensive, they need not, but can be made of the same material(s). In some embodiments, a substrate that can be used to form the label can be printed on to form the communication portion of the insert. The substrate can then have various adhesive and non-adhesive portions formed on one or both surfaces thereof. In some embodiments, a surface of a substrate comprises a permanent adhesive (and an optional release liner) portion for attaching the label to the inner surface of the lid of the container. Alternatively or in addition, the label may comprise printing for the communication portion formed on one side of the label and at least a resealable adhesive portion formed on the opposing side, to function as a sealing area of the label. In some embodiments, a surface of a substrate comprises at least a resealable adhesive, to function as a sealing area, and printing for the communication portion formed on one side of the label and a permanent adhesive (and an optional release liner) portion for attaching to the label to the inner surface of the lid of the container formed on the opposing side.

An insert that is coextensive with a label can also be coextensive with or be attached to another optional portion. This optional portion can function to attach the insert to the remainder of the container. This portion can be referred to as a locating panel. The locating panel can function to maintain the position of the insert during manufacturing, assist in the correct positioning of the label during production, or some combination thereof. Additionally, the insert itself can also be attached to some portion of the container. This can also function to maintain the position of the insert during manufacturing, assist in the correct positioning of the label during production, or some combination thereof. In some embodiments, the insert can have repositionable adhesive or some other method of attachment (e.g., micro-suction, etc.) to attach it to the outer surface of the inner container, the inner surface of the box, or some combination thereof.

The locating panel can be attached to some portion of the container. In some embodiments it can be attached to the outer surface of the inner container, the inner surface of the box, or both. The attachment can be accomplished via a removable adhesive, a permanent adhesive, a permanent adhesive in combination with a release lacquer if the adhesion needs to be broken, or via any other attachment method or methods (e.g., micro-suction).

The locating panel can include a line of weakness or the insert can include a second line of weakness, or some combination thereof, either of which will be referred to as the second line of weakness to distinguish it from the line of weakness between the label and the insert. The second line of weakness can have characteristics and be formed as discussed above, for example. The second line of weakness functions to allows the insert to be removed from the locating panel. The locating panel can be attached to the container, either via attachment to the outer surface of the inner package or the inner surface of the box, and in such a case, removal of the insert from the locating panel via perforating the second line of weakness will remove the insert from the locating panel while the locating panel remains attached to the box.

Preferably, during use the second line of weakness can be broken relatively easily. In some embodiments, the second line of weakness can be broken with less than about 8 Newtons, or even less than about 5 Newtons, or more preferably less than about 3 Newtons. Accordingly then, the first line of weakness must require more force to break than the second line of weakness to avoid unwanted tearing of the first line of weakness. In some embodiments, the first line of weakness can be broken with at least about 12 Newtons, or preferably with at least about 15 Newtons. Breaking the first line of weakness in a transverse direction (e.g., from left to right) can be easier than tearing it in the longitudinal direction and the force necessary for such a transverse tear can therefore be lower.

The container can also comprise an optional inner frame disposed within the box. The inner frame can be disposed inside the front wall of the box. Advantageously, an inner frame with a large surface area provided adjacent the front wall of the box increases the structural strength of the container. This is particularly advantageous for subsequent use when the container is no longer full. A container can also optionally include an inner liner. The inner liner can wrap the consumer goods. The inner liner and the consumer goods can collectively be referred to as an inner package. A carton that includes a lid and at least one sidewall can contain multiple containers as described herein.

Containers of the present invention function to both afford a resealable package and access to an insert. In embodiments where the access region of the insert is covered by the lid when the container is closed, opening the lid of the container will allow for egress and ingress of the insert.

The term "inner surface" is used throughout the specification to refer to the surface of a component of the assembled container that is facing towards the interior of the container, for example towards the consumer goods, when the container is in the closed position. For example, the outer film comprises an inner surface that is facing the housing of the container.

The term "outer surface" is used throughout the specification to refer to the surface of a component of the container that is facing towards the exterior of the container. For example, the outer film comprises an outer surface that is facing away from the housing of the container. It should be noted that the inside or outside surface is not necessarily equivalent to a certain side of a blank used in assembly of the container. Depending on how the blank is folded around the consumer goods, areas that are on the same side of the container can either face towards the inside or the towards the outside of the container.

The terms "front," "back," "upper," "lower," "top," "bottom," and "side" refer to the relative positions of portions of containers according to the invention and components thereof when the container is in an upright position with the lid of the housing in the closed position and the hinge line at the rear of the container. When describing containers according to the present invention, these terms are used irrespective of the orientation of the container being described. The rear or back wall of the container includes the hinge line.

As used herein, the term "below" refers to the vertical direction, along the direction from the bottom of the box to the top of the lid. A more specific term for this could be "vertically below". A first item that is below or vertically below a second item can be coextensive with the second item as long as it is below (along the direction from the bottom of the box to the top of the lid) the second item, for example without a gap between the first item and the second item.

As used herein an item can be "attached" to another item with adhesion or an adhesive, micro-suction, mechanical interlocking, or any other forms or methods of brining two separate elements together such that they will remain together during the intended use thereof. Attached and affixed can generally be used interchangeably. Neither "attached" or "affixed" includes co-extensive with.

Referring now to the drawings, in which some aspects of the present invention are illustrated.

Figure 1:
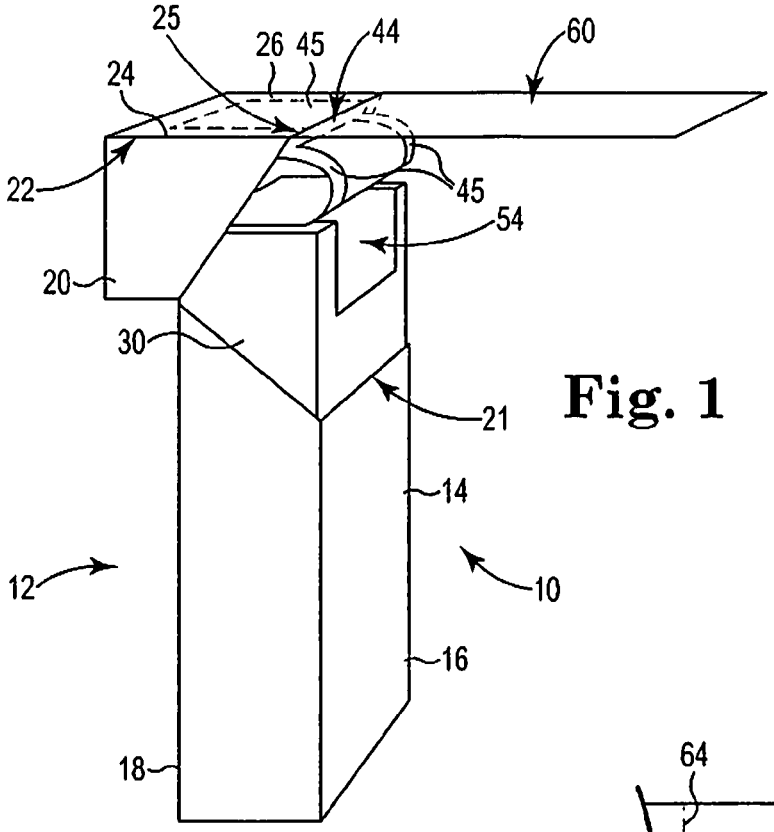
FIG. 1 is a schematic perspective view of a container in an open position, where the container comprises an insert coupled with the label.

Referring to FIG. 1, a schematic perspective view of an embodiment of a container 10 for consumer goods is depicted. The container includes a housing 12 that includes a box 14 and a lid 20 hingedly attached to the box via a hinge line (not shown). The box has a front wall 16 and a rear wall 18. The front wall of the box has an upper edge 21. The lid 20 has a front wall 24 that has an inner surface 22 and an outer surface 26.

An inner package 30 is disposed within the housing 12. The inner package 30 at least partially defines an interior volume for housing consumer goods. The inner package 30 is made from a barrier material or materials to hermetically seal the consumer goods before the container is opened for the first time. The barrier material may be a metal foil or a plastic and metal laminate. The inner package 30 includes an access opening 54 through which the consumer goods (not shown) can be removed. The access opening 54 is covered by a flap 44, when the inner package 30 is closed. Further, the access opening 54 is at least partially uncovered when the flap 44 is in the open position. The flap 44 is attached to and functions to seal the inner package via a label 45. The flap 44 is attached to an inner surface 22 of the front wall 24 of the lid 20 via a label 45 such that upon opening the lid the flap and a portion 55 of the second layer 50 attached to the flap are separated from the inner package 30 along first and second lines of weakness (not shown herein) to reveal the access opening 54. The label also functions to make the inner package resealable via at least a sealing area.

Figure 2:
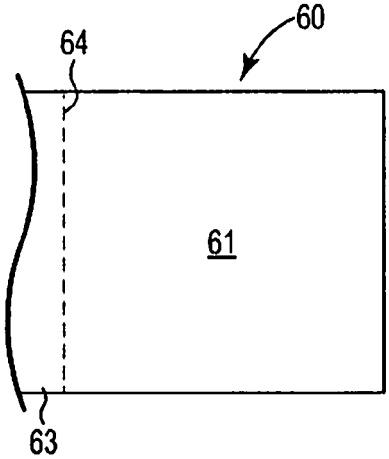
FIG. 2 is a schematic illustration of an insert that can be affixed to a label.

FIG. 2 is a schematic illustration of an insert 60 that can be affixed to a label. The insert 60 includes a communication portion 61, a line of weakness 64 and an attachment portion 63. The communication portion 61 could include printing on one or both sides thereof.

Figure 3:
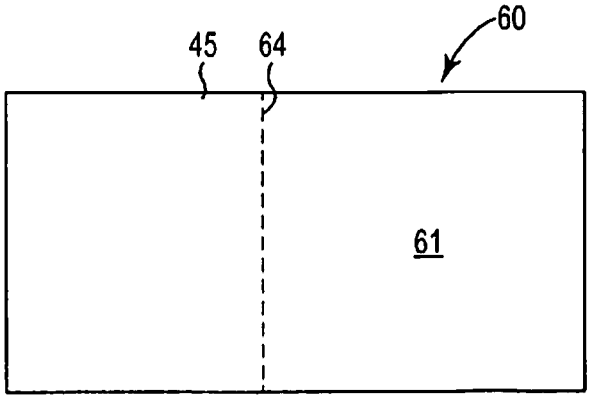
FIG. 3 is a schematic illustration of an insert that is coextensive with a label.

FIG. 3 is a schematic illustration of an insert that is coextensive with a label. The insert 60 includes a communication portion 61 and a line of weakness 64. The communication portion 61 could include printing on one or both sides thereof. The label portion 45 can include on a first surface at least a non-sealing area and a sealing area that functions to seal the inner package and on the second opposing surface a permanent adhesive that functions to attach it as well as the flap of the inner package to the inner surface of the lid. The label portion could also comprise other features not seen in these embodiments.

Figures 4, 5, 6:
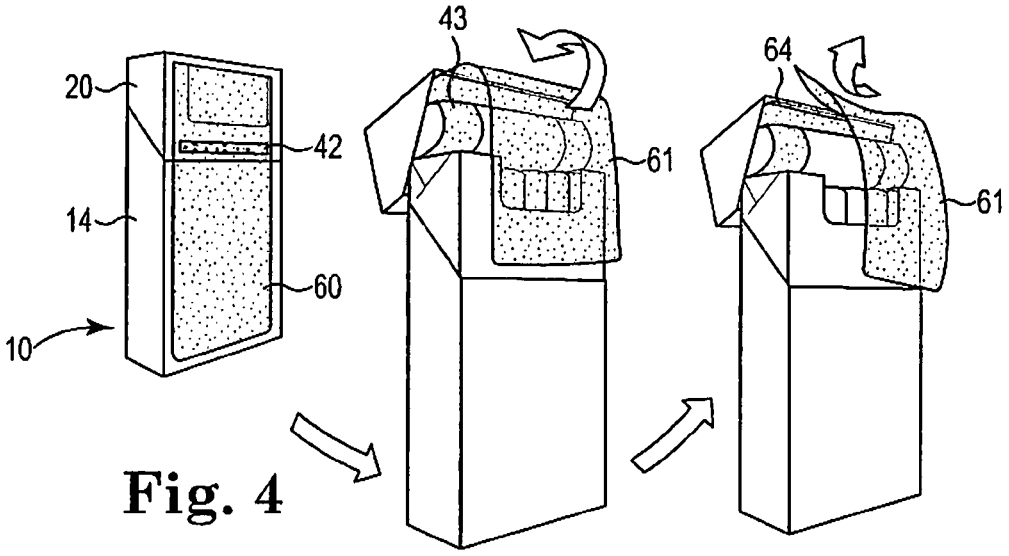
FIGS. 4 to 6 illustrate schematic perspective views of a container that includes an insert that is part of or an extension of the label at various points of opening.

FIGS. 4 to 6 illustrate schematic perspective views of a container that includes an insert that is part of or an extension of the label at various points of opening. The container 10 includes a box 14 and a lid 20. Attachment region 42 indicates the point at which the extended label is affixed to the inner surface of the lid. (FIG. 4). Upon opening the container by separating the sealing area 43 of the label from the inner package, the communication portion 61 of the insert rises away from the box 14 (FIG. 5). The line of weakness 64, which can be positioned just below the attachment region 42 can then be broken to allow the communication portion 61 of the insert 60 to be removed from the container 10 (FIG. 6). It should be noted, as seen in FIGS. 5 and 6, opening the container via pushing the lid 20 back automatically forces the insert 60 to rise away from the box 14. Because of the location of the attachment portion 42 and the line of weakness 64, breaking the line of weakness 64 and removing the communication portion 61 does not leave any of the extended label or label to insert combination beyond the bottom edge of the lid.

Figure 7:
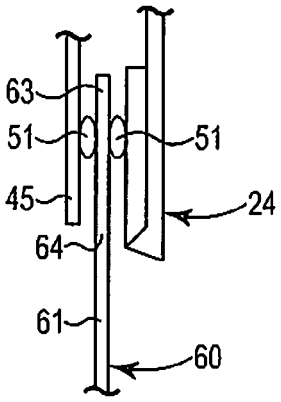
FIG. 7 depicts a cross section of an illustrative example of one configuration in which an insert can be affixed to a label.

FIG. 7 depicts a cross section of an illustrative example of one configuration in which an insert can be affixed to a label. In FIG. 7, the label 45 can be affixed to the insert 60 that comprises in this case, the communication portion 61, the line of weakness 64 and the attachment portion 63; and the insert can be affixed to the lid 24. The sealing regions 51 located between each of the components can include mechanical attachments, adhesive, thermal attachments, ultrasonic bonding, or any combination thereof for example. Preferably, the sealing regions 51 comprise adhesive. As seen in this illustration, the insert and the label are preferably positioned so that the line of weakness 64 is relatively close to the lid, or even more preferably above the lower edge of the lid so that no portion of the insert is visible below the lid once the communication portion 61 has been removed.

Figure 8:
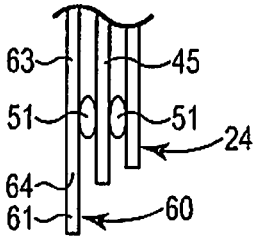
FIG. 8 depicts a cross section of an illustrative example of another configuration in which an insert can be affixed to a label.

FIG. 8 depicts cross section of an illustrative example of another configuration of how an insert can be affixed to a label. In FIG. 8, the insert 60 (comprising a communication portion 61, a line of weakness 64 and an attachment portion 63) can be affixed to the label 45 and the label 45 can be affixed to the lid 24. The sealing regions 51 located between each of the components can include mechanical attachments, adhesive, thermal attachments, ultrasonic bonding, or any combination thereof for example. Preferably, the sealing regions 51 comprise adhesive. As seen in this illustration, the insert and the label are preferably positioned so that the line of weakness 64 is relatively close to the lid, or even more preferably above the lower edge of the lid so that no portion of the insert is visible below the lid once the communication portion has been removed.

Figures 9, 10, 11:
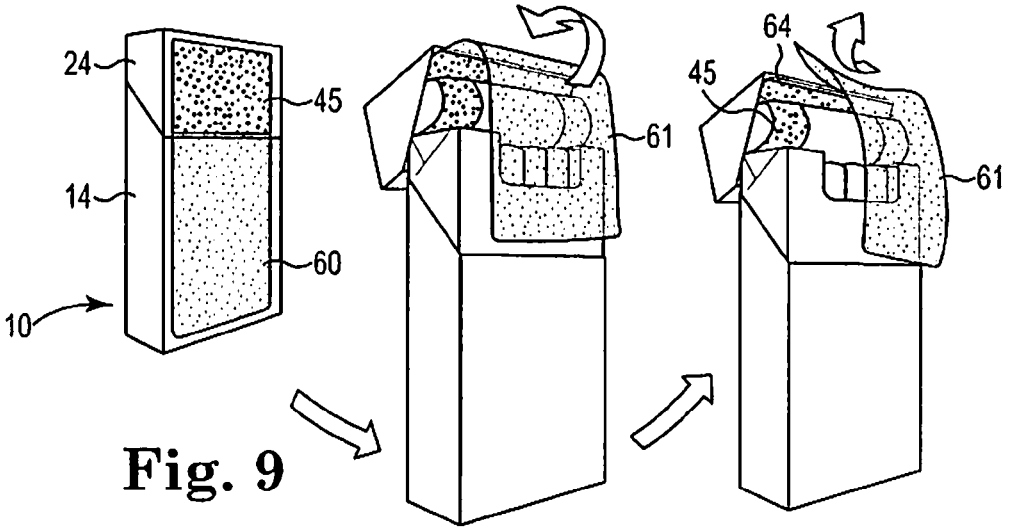
FIGS. 9 to 11 illustrate schematic perspective views of a container that includes an insert that is affixed to a label at various points of opening.

FIGS. 9 to 10 illustrate schematic perspective views of a container that includes an insert that is affixed to a label at various points of opening. The container 10 includes a box 14 and a lid 20. The label 45 in this embodiment assists in maintaining the resealable closure of the container (FIG. 9). Upon opening the container the communication portion 61 of the insert rises away from the box 14 (FIG. 10). The line of weakness 64 can then be broken to allow the communication portion 61 of the insert to be removed from the container 10 (FIG. 11). Because of the location of the line of weakness 64, breaking the line of weakness 64 and removing the communication portion 61 does not leave any of the insert beyond the bottom edge of the lid.

Figure 12:
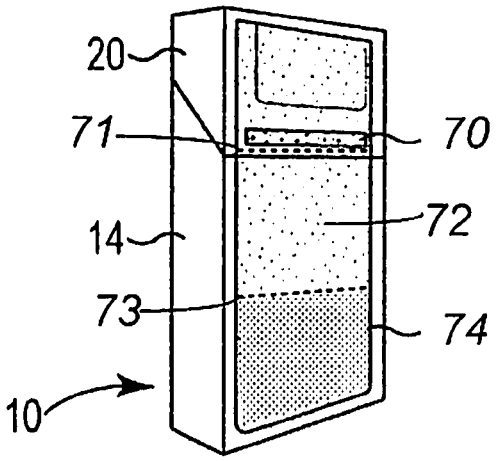
FIGS. 12 to 14 illustrate schematic perspective views of a container that includes an insert that is coupled to a label and a locating portion.
Figure 13:
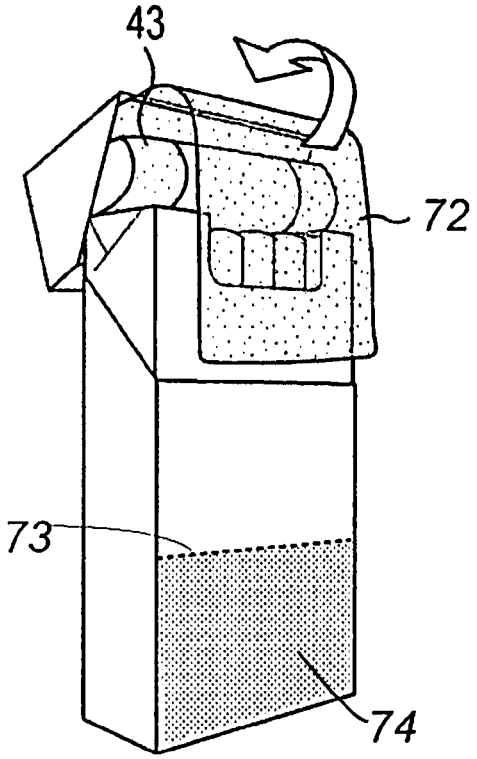
Figure 14:
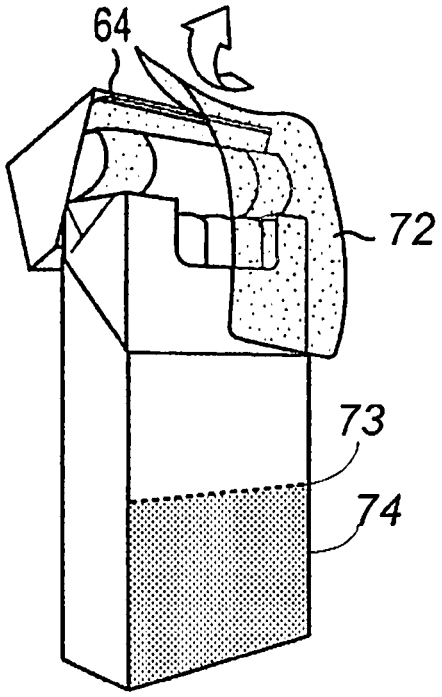

FIGS. 12 to 14 illustrate schematic perspective views of a container that includes an insert that is coupled to a label and a locating portion at various points of opening. The container 10 includes a box 14 and a lid 20. Attachment region 70 indicates the point at which the extended label is affixed to the inner surface of the lid. (FIG. 12). Upon opening the container by separating the sealing area of the label from the inner package, the communication portion 72 of the insert rises away from the box 14 (FIG. 13) and the second line of weakness 73, which is positioned between the communication portion 72 and the locating portion 74 is also broken to allow the insert to be removed from the container 10. The first line of weakness 71, which can be positioned just below the attachment region 70 can then be broken to allow the communication portion 72 of the insert to be removed from the container 10 (FIG. 14). It should be noted, as seen in FIGS. 13 and 14, opening the container via pushing the lid 20 back automatically forces the insert to rise away from the box 14. Because of the location of the attachment portion 70 and the first line of weakness 71, breaking the first line of weakness 71 and removing the communication portion 72 does not leave any of the extended label or label to insert combination beyond the bottom edge of the lid. The locating portion 74 remains attached to the container after removal of the communication portion 72.

The invention claimed is:

1. A container (10) for consumer goods, comprising:

a housing (12) comprising a box (14) and a lid (20) hingedly attached to the box, wherein the box comprises an interior volume and the lid has an inner (22) and an outer (26) surface, a front wall (24) and a front bottom edge;

an inner package (30) disposed at least partially within the interior volume of the box and at least partially defining an interior volume for housing consumer goods; a resealable label (45) configured to open and close the inner package when the lid of the housing is opened and closed, wherein the resealable label is positioned adjacent the inner surface of the front wall of the lid; and an insert (60), the insert comprising a first a line of weakness (64), a second line of weakness (73), and a communication portion (61), wherein the insert is coupled to the resealable label to maintain connection of the insert with the container until the first line of weakness is broken; and a locating portion (74), wherein the second line of weakness is between the locating portion and the insert.

2. The container of claim 1, wherein opening the container automatically forces the insert away from the container.

3. The container of claim 1, wherein the insert is a different material than the housing.

4. The container of claim 1, wherein the insert is an extension of the resealable label and the insert extends beyond the bottom edge of the lid.

5. The container of claim 1, wherein the line of weakness of the insert separates the communication portion of the insert from the resealable label.

6. The container of claim 1, wherein the resealable label is affixed to the inner surface of the front wall of the lid.

7. The container of claim 6, wherein the resealable label and the insert are positioned so that the line of weakness is positioned above the bottom edge of the lid but below the position where the resealable label is affixed to the inner surface of the front wall of the lid.

8. The container of claim 1, wherein the insert is at least partially adhered to both the label and the inner surface of the front wall of the lid.

9. The container of claim 1, wherein the communication portion of the insert is attached to the inner container or the box.

10. The container of claim 1, wherein the line of weakness, the second line of weakness and the inner package can all be broken with a force not greater than about 15 N.

11. A container (10) for consumer goods, comprising:

a housing (12) comprising a box (14) and a lid (20) hingedly attached to the box, wherein the box comprises an interior volume and the lid has an inner (22) and an outer (26) surface, a front wall (24) and a front bottom edge;

an inner package (30) disposed at least partially within the interior volume of the box and at least partially defining an interior volume for housing consumer goods; a resealable label (45) configured to open and close the inner package when the lid of the housing is opened and closed, wherein the resealable label is positioned adjacent the inner surface of the front wall of the lid;

an insert (60), the insert characterized by comprising a line of weakness (64) and a communication portion (61), wherein the insert is affixed to the resealable label to maintain connection of the insert with the container until the line of weakness is broken, wherein the label is positioned between the insert and the inner surface of the front wall of the lid.

12. A container (10) for consumer goods, comprising:

a housing (12) comprising a box (14) and a lid (20) hingedly attached to the box, wherein the box comprises an interior volume and the lid has an inner (22) and an outer (26) surface, a front wall (24) and a front bottom edge;

an inner package (30) disposed at least partially within the interior volume of the box and at least partially defining an interior volume for housing consumer goods;

a resealable label (45) configured to open and close the inner package when the lid of the housing is opened and closed, wherein the resealable label is positioned adjacent the inner surface of the front wall of the lid;

an insert (60), the insert characterized by comprising a line of weakness (64) and a communication portion (61), wherein the insert is affixed to the resealable label to maintain connection of the insert with the container until the line of weakness is broken, wherein the line of weakness of the insert is positioned between the bottom edge of the lid and the point at which the insert is affixed to the resealable label.

* * * * *